United States Patent [19]

Tokumitsu

[11] 4,248,834

[45] Feb. 3, 1981

[54] APPARATUS FOR QUENCHING PYROLYSIS GAS

[75] Inventor: Ichiro Tokumitsu, Tokyo, Japan

[73] Assignee: Idemitsu Petrochemical Co. Ltd., Tokyo, Japan

[21] Appl. No.: 36,752

[22] Filed: May 7, 1979

[51] Int. Cl.[3] ..... F28D 7/10

[52] U.S. Cl. ..... 422/200; 165/106; 208/48 Q; 422/187; 422/207

[58] Field of Search ..... 422/187, 200, 207; 165/104 R, 106; 208/48 Q

[56] References Cited

U.S. PATENT DOCUMENTS

| | | | |
|---|---|---|---|
| 2,115,714 | 5/1938 | Houdry et al. | 422/200 |
| 2,391,315 | 12/1945 | Hulsberg | 422/200 X |
| 2,515,435 | 7/1950 | Allen | 422/200 X |
| 2,585,274 | 2/1952 | Reichl | 422/200 X |
| 2,877,866 | 3/1959 | Mathis et al. | 422/207 X |
| 3,682,241 | 8/1972 | Clauss et al. | 208/48 Q X |
| 4,016,066 | 4/1977 | Shiraiwa et al. | 208/48 Q |
| 4,121,908 | 10/1978 | Raab et al. | 208/48 Q X |

FOREIGN PATENT DOCUMENTS

| | | |
|---|---|---|
| 48-34363 | 5/1973 | Japan . |
| 49-113254 | 10/1974 | Japan . |

*Primary Examiner*—Richard L. Chiesa
*Attorney, Agent, or Firm*—Fred Philpitt

[57] ABSTRACT

An apparatus for quenching pyrolysis gas, in which cooling of pyrolysis gas of hydrocarbons can be carried out very rapidly, decoking of pyrolysis furnace can be carried out easily and the life of apparatus can be extremely extended, is provided according to the apparatus in which the upper outlet of each of cracking tubes of a multi-tubular pyrolysis furnace for hydrocarbons is connected directly with each of vertical introducing pipes for pyrolysis gas, having a diameter larger than that of said upper outlet, and situated on a level upper than that of said upper outlet; cooling pipes for pyrolysis gas having closed lower ends are inserted in said introducing pipes in the same direction therewith; pipes for flowing-in a cooling medium, the lower ends of which pipes open into said cooling pipes at the position close to the closed ends of the cooling pipes are provided and opening parts for each of fluids are provided in the neighborhood of the upper ends of said introducing pipes and said cooling pipes, respectively.

2 Claims, 3 Drawing Figures

APPARATUS FOR QUENCHING PYROLYSIS GAS

FIELD OF THE INVENTION

The present invention relates to an apparatus for quenching pyrolysis gas which enables to cool pyrolysis gas of hydrocarbons very rapidly and to ease decoking of pyrolysis apparatus.

BACKGROUND OF THE INVENTION

It has heretofore been known that quenching of the high temperature pyrolysis gas obtained by the pyrolysis reaction of hydrocarbons is important in order to prevent formed olefins from suffering a loss due to side reactions, but in a practical pyrolysis apparatus, the direct connection of the heating part for pyrolysis to the cooling part of pyrolysis gas is impossible due to a large thermal stress acting in the connecting parts. Accordingly, it has been unavoidable to contrive to install various kinds of thermal-stress-removing parts between the above-mentioned heating part and the cooling part. However, this has not been preferable in the point of olefin yield.

On one hand, in cooling the high temperature pyrolysis gas obtained by the pyrolysis reaction of hydrocarbons, heavier components in the pyrolysis gas at high temperatures form cokes by condensation or polymerization, which block cooling pipes for pyrolysis gas and make the continuous operation of a pyrolysis furnace infeasible. On this account, the removal of cokes has been frequently carried out. However, since it is not permissible for the cooling part for pyrolysis gas to be under thermal stress because of the necessity from its general structure, the cokes cannot be removed by burning. Thus, it has been obliged to stop the feed of raw material hydrocarbons to extinguish the burners of the furnace and stop the operation of the pyrolysis furnace and to carry out the removal of cokes by way of a mechanical process such as washing with a high pressure water, scraping-off with a drill or the like. For the above-mentioned reason, it has been obliged to stop the pyrolysis apparatus for a long period of time.

Under the above-mentioned circumstance, we have been studying in various ways about the quenching apparatus for pyrolysis gas which enables us to attain two objects simultaneously, i.e., a first object of making quenching of pyrolysis gas feasible and a second object of shortening of the term required for decoking.

PREFERRED EMBODIMENT OF THE PRESENT INVENTION

As a result of the above-mentioned study, we have found a quenching apparatus for hydrocarbon pyrolysis gas in which the upper outlet of each of cracking tubes of a multi-tubular pyrolysis furnace for hydrocarbons is connected directly with each of vertical introducing pipes for pyrolysis gas, having a diameter larger than that of said upper outlet, and situated on the level upper than that of said upper outlet; cooling pipes for pyrolysis gas having closed lower ends are inserted in and along said introducing pipes in the same direction (or substantially in coaxial relation); pipes for flowing-in a cooling medium, the lower ends of which pipes open into said cooling pipes at the position close to the closed ends of the cooling pipes are provided; and opening parts for each of fluids are provided in the neighbourhood of the upper ends of said introducing pipes and said cooling pipes, respectively.

Accordingly, in the quenching apparatus for pyrolysis gas of the present invention, the cracking tubes for pyrolysis employed for a pyrolysis furnace for hydrocarbons must have at least an outlet part opened above the pyrolysis furnace and the introducing pipes for pyrolysis gas must have a diameter greater than those of the cracking tubes for pyrolysis after passing through introducing enlarged parts in order that the flow rate of pyrolysis gas is maintained.

As a cooling medium in the present invention, a high pressure saturated water is preferable. It descends the inside of the flowing-in pipe for a cooling medium, flows out from its opening part into the inside of the cooling pipes for pyrolysis gas, carries out quenching heat exchange with the pyrolysis gas by the medium of pipe walls of the cooling pipes, ascends easily due to the difference of specific gravity while partly generating high pressure saturated steam, and is collected through the take-out holes for high pressure saturated steam or the like, which is situated in the neighbourhood of the upper end of the cooling pipes for pyrolysis gas, to effect heat recovery.

Accordingly, from the above-mentioned description, it will be understood that these triple pipes which constitute the principal part of the quenching apparatus of the present invention must be arranged in the vertical direction. The quenched pyrolysis gas is collected through the take-out holes in the neighbourhood of the upper end of said introducing pipes for pyrolysis gas, i.e., in the neighbourhood of the connection part of the introducing pipes and the cooling pipes and further sent to the step in which purification and separation of each of the components are carried out.

As explained above, in the quenching apparatus for pyrolysis gas of the present invention, since the cracking tubes in the pyrolysis furnace and the cooling part of pyrolysis gas are so directly connected that the connection part is not acted upon by thermal stress, no mechanical problem occurs. In addition, since the time which lapses before cooling of pyrolysis gas is initiated can be shortened down to an extremely short time to such an extent as one several tenth minutes of the conventional time by shortening so-called transfer zone, side reactions of olefins caused by pyrolysis can be prevented as much as possible. Accordingly, there is an advantage that olefin can be obtained with a higher yield than that of the conventional process.

The decoking of the quenching apparatus of the present invention can be carried out in the state of so-called on-line decoking where the heating of a pyrolysis furnace is continued to be conveniently enough in view of its mechanical structure. That is, removal of cokes by burning and the decoking of cracking tubes in the pyrolysis furnace can be simultaneously carried out by supplying air in place of hydrocarbon raw material after stopping the feed of cooling medium. Accordingly, there is no need of a long-term suspension of operation of the apparatus at the time of decoking of the pyrolysis apparatus unlike the conventional apparatus. Thus, about a week of suspension was usually the case in conventional apparatuses, whereas 2 or 3 days will be sufficient for the apparatus of the present invention. Further, since the troublesome step of decoking operation itself which has heretofore been carried out by relying on a mechanical process, can be omitted, a great deal of benefit can be realized from the above-mentioned advantage together with economical effect brought about by the increase in the operation efficiency of the pyrolysis apparatus. There is also another advantage in extremely extended life of a pyrolysis apparatus because the frequency of repetition of heating and cooling of a pyrolysis furnace can be greatly reduced by on-line decoking.

The present invention will be further described by way of an example.

Figure 1:
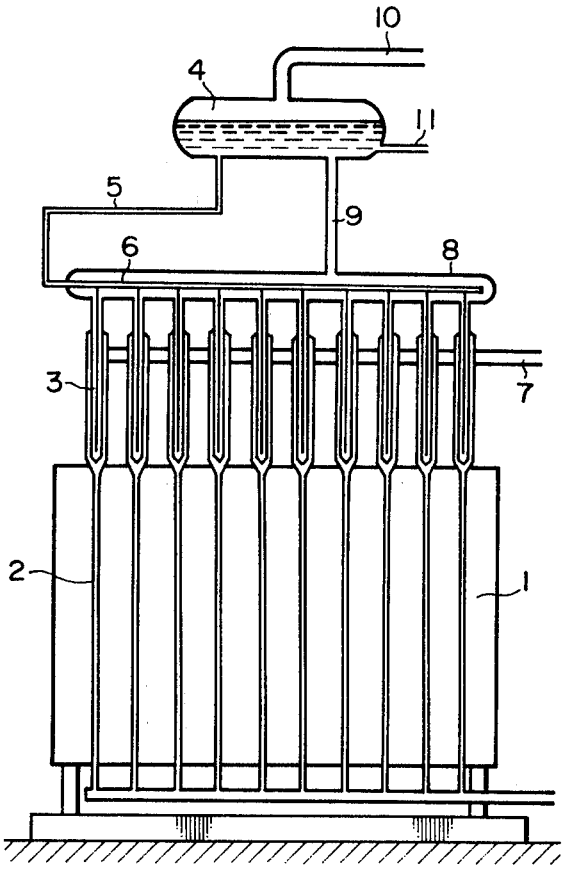
FIG. 1 is a schematic view illustrating the whole of a pyrolysis furnace employing a pyrolysis gas-quenching apparatus of the present invention.
Figure 2:
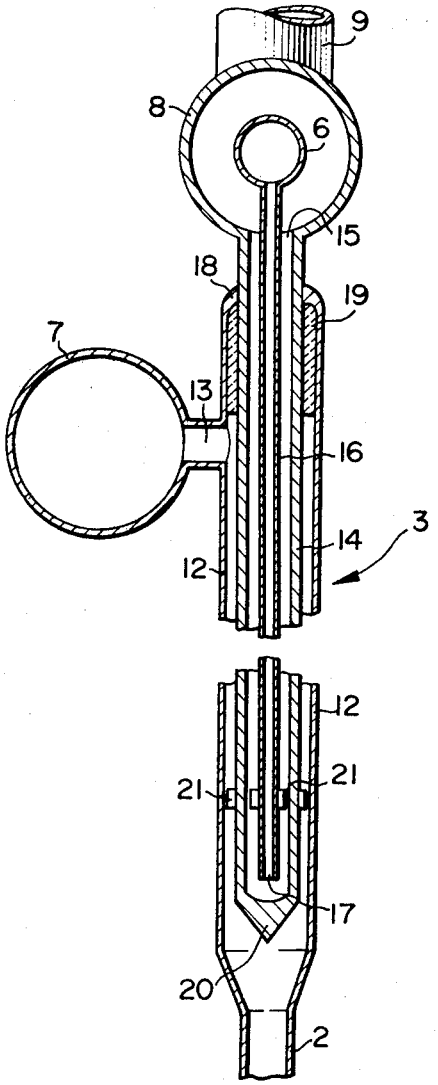
FIG. 2 is a longitudinally cross-sectional view illustrating the principal part of the pyrolysis gas-quenching apparatus of the present invention.
Figure 3:
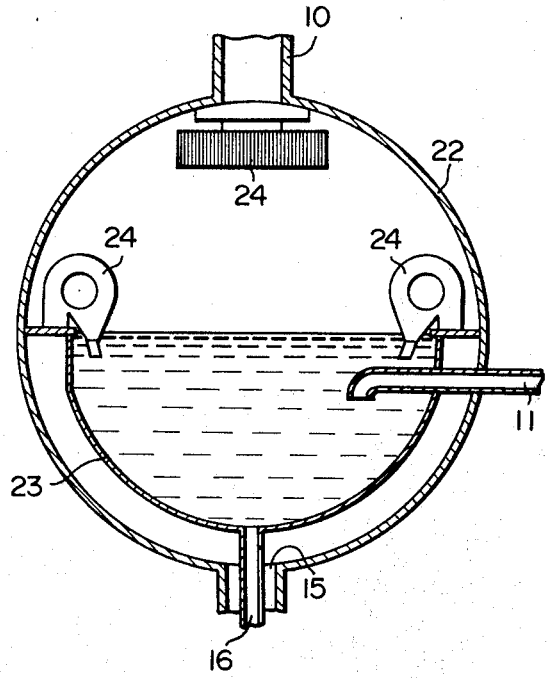
FIG. 3 is a cross-sectional view illustrating an embodiment of a steam-water-separating drum employed in the apparatus of the present invention.

As shown in FIG. 1, a pyrolysis gas having left each of cracking tubes 2 inside a pyrolysis furnace 1 is introduced into a pyrolysis gas-quenching apparatus 3, into which a high pressure saturated water is introduced through a high pressure saturated water-descending pipe 5 and a manifold of inlet pipes for the high pressure saturated water 6, from the bottom part of a steam-water-separating drum 4. The resulting quenched pyrolysis gas is caught and collected in a manifold for exit pipes for quenched pyrolysis gas 7 and led to a downstream location. On the other hand, the high pressure saturated water is heated and caught and collected in a manifold 8 containing exit pipes for the high pressure saturated water, in a state where the high pressure saturated water has been partly turned into a high pressure saturated steam and then introduced into the steam-water-separating drum 4 through a high pressure saturated water-ascending pipe 9. The high pressure saturated steam separated in the steam-water-separating drum 4 is recovered through a high pressure saturated steam pipe 10, and the high pressure saturated water is circulated and used for quenching the pyrolysis gas. In addition, a high pressure water is always supplied into the steam-water-separating drum 4 through a high pressure water pipe 11. Further with regard to the supply of the high pressure saturated water and the recovery of the high pressure saturated water containing the high pressure saturated steam, a steam-water-separating drum 22 as shown in FIG. 3 may be employed in place of those as shown in FIG. 1 and FIG. 2. In FIG. 3, a pool for the high pressure saturated water 23 is directly connected to the pyrolysis gas-quenching apparatus 3 via a flow-in pipe for the high pressure saturated water 16, and the high pressure saturated steam coming through an exit for the high pressure saturated water 15 is separated from the high pressure saturated water by means of a steam-water-separator 24 such as a cyclone. Thus the high pressure saturated steam is recovered through a pipe for the high pressure saturated steam 10, while the separated high pressure saturated water is collected in the pool for the high pressure saturated water 23 and reused.

As seen in FIG. 2, the pyrolysis gas-quenching apparatus 3 of the present invention consists of a pyrolysis gas-introducing pipe 12 connected directly to each of cracking tubes 2 inside a pyrolysis furnace 1 and an exit for the quenched pyrolysis gas 13; a pyrolysis gas-cooling pipe 14 inside said pyrolysis gas-introducing pipe 12 and an exit for the high pressure saturated water 15; and a flow-in pipe for the high pressure saturated water 16 inside said cooling pipe 14 and an exit for the high pressure saturated water 17. The exit for the quenched pyrolysis gas 13 is located in the neighbourhood of a joint part 18 of said pyrolysis gas-introducing pipe 12 to said cooling pipe 14, and if the temperature at which the pyrolysis gas is cooled is relatively high, it is preferable to provide said exit 13 at a location somewhat apart from said joint part 18, and to fill a heat insulator between said exit 13 and said joint part 18 so that heat stress is not applied onto said joint part 18. As for the closed end 20 of said pyrolysis gas-cooling pipe 14, since pyrolysis gas at high temperature contacts directly with the end, it is preferable that the end takes a conical form or a spherical form, for the purpose of reducing the impact of the high temperature pyrolysis gas and also preventing the erosion thereby. In the above-mentioned triple pipes, suitable supporting plates 21 are provided for holding the respective pipe walls in parallel.

Into the above-mentioned pyrolysis-quenching apparatus 3, a pyrolysis gas obtained by subjecting a naphtha having a specific gravity of 0.70 to pyrolysis in a steam-oil ratio of 0.6°, at 850° C. was supplied and was quenched employing as a cooling medium, a high pressure saturated water under 135 kg/cm$^2$ (gauge) at 350° C. so that the temperature of the pyrolysis gas at the exit for the pyrolysis gas 13 reaches 500° C. The composition of the resulting pyrolysis product in this case is shown in Table 1 together with that in case of a conventional apparatus for quenching pyrolysis gas having a retention time at the transfer zone, of 0.05 second.

TABLE 1

| Composition of pyrolysis product | Example | Comparative example |
|---|---|---|
| Hydrogen | 1.0 | 1.1 |
| Methane | 13.0 | 14.0 |
| Ethylene | 28.0 | 27.1 |
| Propylene | 13.6 | 13.0 |
| Oil component | 28.5 | 29.4 |
| | | (% by weight) |

What is claimed is:

1. In an apparatus that includes a hydrocarbon pyrolysis furnace containing a plurality of vertical elongated cracking tubes, each tube having a lower inlet and an upper outlet, the upper outlets of said cracking tubes being connected to a unit for quenching the hot pyrolysis gases, said quenching unit comprising:

(a) a plurality of vertical pipes, each of said pipes being vertically aligned above one of said cracking tubes and each of said pipes having a diameter larger than the diameter of the cracking tube that is below it, each of said vertical pipes having a lower inlet end that is connected to the upper outlet end of the cracking tube with which it is vertically aligned and an outlet end that is connected to a manifold for the passage of cooled pyrolysis gases, and (b) cooling means inside each of said vertical pipes for the indirect cooling of the pyrolysis gases flowing through said vertical pipes, said cooling means comprising:

(1) a cooling pipe extending coaxially downwardly into the interior of each of said vertical pipes, each such cooling pipe having a closed lower end, there being sufficient clearance between the outer surface of each cooling pipe and the inner surface of each vertical pipe for the upward flow of pyrolysis gases therebetween, (2) a water inlet pipe extending coaxially downwardly into the interior of each of said cooling pipes, each such water inlet pipe having an open lower end that is adjacent the lower end of said cooling pipe, there being sufficient clearance between the outer surface of each water inlet pipe and the inner surface of each cooling pipe for the upward flow of water or a mixture of water and steam, said water inlet pipe having an upper inlet for the introduction of water, and (3) a receiving container for receiving the water or mixture of water and steam exiting from said cooling pipe.

2. An apparatus according to claim 1 wherein said receiving container is a drum for separating steam and water and there is a passageway connecting the water reservoir portion of said drum to said water inlet pipe.

* * * * *